US005263063A

United States Patent [19]

Sappey

[11] Patent Number: 5,263,063

[45] Date of Patent: Nov. 16, 1993

[54] DEVICE FOR LOCKING A FUEL ASSEMBLY IN A CONTAINER

[75] Inventor: Philippe Sappey, Condrieu, France

[73] Assignees: Framatome, Courbevoie; Cogema, Velizy-Villacoublay, both of France

[21] Appl. No.: 856,259

[22] Filed: Mar. 25, 1992

[30] Foreign Application Priority Data

Mar. 25, 1991 [FR] France ..... 91 03586

[51] Int. Cl.[5] ..... G21C 19/06

[52] U.S. Cl. ..... 376/261; 376/272; 410/120

[58] Field of Search ..... 376/261; 976/DIG. 247, 976/DIG. 344, DIG. 352, DIG 341; 410/120; 248/316.5, 316.1

[56] References Cited

U.S. PATENT DOCUMENTS 1,745,050 1/1930 Romine ..... 410/120
3,732,427 5/1973 Trudeau et al. ..... 376/272
4,365,919 12/1982 Mehki ..... 410/120
4,780,268 10/1988 Papai et al. ..... 376/272
5,065,688 11/1991 Moody ..... 410/47

FOREIGN PATENT DOCUMENTS 1816856 7/1970 Fed. Rep. of Germany ..... 376/272

*Primary Examiner*—Daniel D. Wasil
*Attorney, Agent, or Firm*—Pollock, Vande Sande & Priddy

[57] ABSTRACT

The device comprises a cradle (4) having at least one supporting surface on which the object (6) rests, at least one flange (5) pivotably mounted on the cradle (4) and members (14, 16, 20) for locking the flange (5a, 5b) in its turned-down position. The device further comprises a bearing block (38) connected to the flange in an articulated manner, a shoe (40) mounted on the bearing block (38) for limited displacement and having two bearing surfaces (40a) directed towards the object (6), in the turned-down position of the flange, and a leaf spring (41) interposed between the bearing block (38) and the shoe (40).

10 Claims, 3 Drawing Sheets

DEVICE FOR LOCKING A FUEL ASSEMBLY IN A CONTAINER

FIELD OF THE INVENTION

The invention relates to a device for fastening an object to a transport structure, and more particularly to a device for locking a fuel assembly for nuclear reactors, in a transport container.

BACKGROUND OF THE INVENTION

Fuel assemblies for nuclear reactors and particularly for pressurized water nuclear reactors consist of a bundle of very long fuel rods which are held in a framework, in such a way that the rods are parallel to one another and are arranged in regular network in the transverse planes of the assembly perpendicular to its longitudinal direction.

The fuel rods are held by spacer grids uniformly spaced over the length of the assembly and forming elements of the framework.

The fuel assemblies of pressurized water nuclear reactors in operation at the present time have a length for over four meters and a square cross-section, the side of which has a length of approximately twenty centimeters on each side. The fuel assemblies intended for nuclear reactors of a power of 900 MW comprise eight spacer grids uniformly spaced over the length of the assembly, and the fuel assemblies intended for reactors of a power of 1300 MW have ten spacer grids. The outer lateral faces of the spacer grids project slightly in relation to the bundle of fuel rods of the assembly.

In order to transport the fuel assemblies, for example new fuel assemblies intended for refuelling the core of a nuclear reactor, containers are employed in which two fuel assemblies are arranged and locked during transportation.

The transport containers comprise lower and upper half-shells which can be assembled together by screwing, of which the lower half-shell of the container receives an underframe or cradle for supporting the fuel assemblies and of which the upper half-shell forms the cover of the container.

The supporting cradle of the fuel assemblies consists of an elongate structure, the T-shaped cross-section of which provides, for each of the fuel assemblies, two supporting surfaces at right angles which are arranged on either side of the middle part of the cradle forming a partition wall for the two assemblies.

The cradle rests within the lower half-shell of the container by means of shock-absorbing studs.

Each of the assemblies arranged in a container comes to bear against the cradle with two successive lateral faces at 90° of its spacer grids. The clamping of the assemblies against the bearing surfaces of the cradle is ensured by flanges arranged level with each of the spacer grids of the assemblies.

In the prior art, level with each of the spacer grids of each of the fuel assemblies in the transport position on the cradle, two half-flanges are mounted in an articulated manner on the cradle so as to be capable of being turned down in the direction of the fuel assembly and of the supporting surfaces when the assembly has been fastened. The half-flanges in the turned-down position are connected to one another by means of a screw connection. Each of the half-flanges carries a device for clamping the assembly, consisting of a threaded rod engaged in the corresponding half-flange and carrying a bearing shoe at its end. The clamping of the assembly is ensured by bringing the shoes to bear, with some pressure, on the outer lateral surfaces of the spacer grids opposite the faces of these spacer grids bearing on the cradle, by means of a nut and a lock nut which are engaged on the threaded rod.

To ensure the clamping and flanging of the assembly on the cradle, it is therefore necessary to turn down each of the two half-flanges, to ensure the assembling together of the two half-flanges by clamping the screw connection and to bring the shoes to bear by torque-clamping of each of the nuts.

These operations, must be conducted for each of the spacer grids of the fuel assemblies, are relatively time-consuming and require the attendance of well-trained personnel, inasmuch as defective fastening of the assemblies occurring as a result of insufficient clamping can result in damage to the assemblies during their transportation. Likewise, excessive clamping of the shoes can cause damage to the spacer grids of the assemblies.

Moreover, the use of wrenches for clamping the screw connections and the nuts of the shoes entails some risk that these wrenches, which are of considerable mass, will fall onto the fuel assemblies and that the rods of the assemblies will therefore be damaged. Falling tools can also cause physical injury to the operators responsible for putting the fuel assemblies into the container.

It is clear that the clamping devices of the prior art also have similar disadvantages when the fuel assemblies are unloaded after a container has been opened. In fact, it is necessary to unclamp the shoes and the flanges before the cradle and the assemblies have been raised vertically, for example by use of a mechanical device for raising the underframes.

In more general terms, in many sectors of industry, it is necessary to transport heavy components inside containers or on transport underframes after effective clamping or flanging of the components.

This clamping of the components on their transport underframe is generally executed by using screw connections fastened to a flanging part of the structure opposite the bearing faces of the object to be transported.

The clamping torque of these screw connections has to be carefully controlled.

The corresponding operations are therefore relatively time-consuming and complex and usually require the attendance of highly competent personnel.

SUMMARY OF THE INVENTION

The object of the invention is to provide a device for the rapid and simple fastening of an object to a transport structure comprising a cradle having at least one supporting surface on which the object rests, and at least one flange mounted for pivoting movement about an axle on the cradle between a raised position, remote from the supporting surface, and a position turned down in the direction of the supporting surface, as well as means for locking the flange in its turned-down position, the device making effective fastening of the object to the structure in a simple and rapid manner, without damage to the object to be fastened as a result of excessive clamping.

To this end, the device according to the invention comprises at least one clamping set consisting of a bearing block connected to the flange in a manner articulated about an axle substantially parallel to the pivot axle of the flange, a shoe mounted on the bearing block for limited displaced in relation to the bearing block in a direction allowing it to be brought toward or away from the bearing block of the flange and comprising a bearing surface directed towards the supporting surface of the cradle, in the turned-down position of the flanges, and a leaf spring interposed between the bearing block and the shoe, so as to exert a return force on the shoe in a direction bringing it away from the bearing block and the flange.

The invention also relates to a device for locking a fuel assembly in a transport container.

BRIEF DESCRIPTION OF THE DRAWINGS

To facilitate comprehension of the invention, an embodiment of the device according to the invention, used for locking fuel assemblies of a pressurized-water nuclear reactor in transport containers, will now be described by way of example with reference to the accompanying drawings.

DESCRIPTION OF PREFERRED EMBODIMENT

Figure 1:
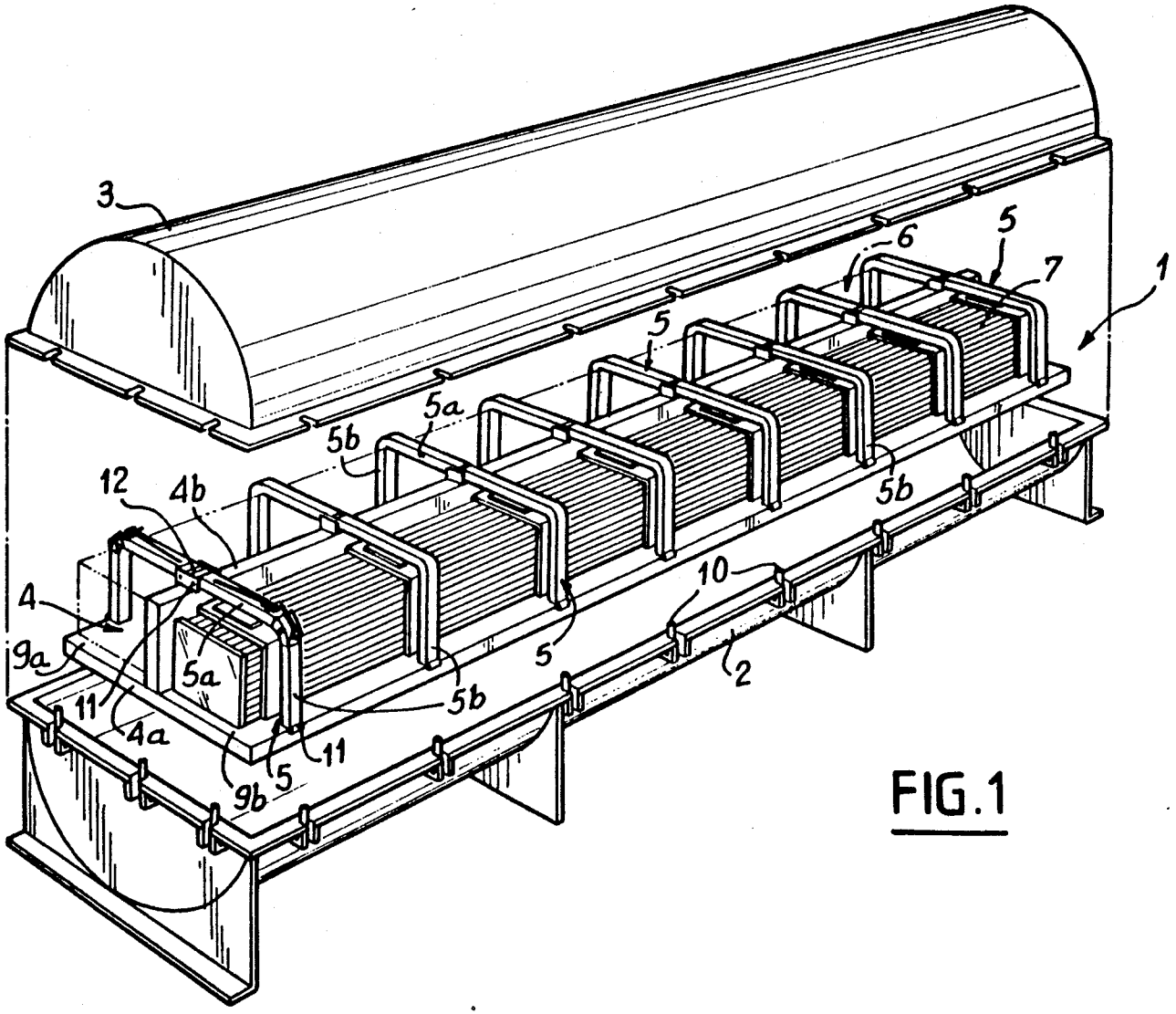
FIG. 1 is a perspective view of a transport container for fuel assemblies of a pressurized-water reactor, the cover of which is open and which contains two assemblies in the transport position.

FIG. 1 shows a transport container 1 for fuel assemblies, consisting of a lower half-shell 2 and an upper half-shell 3 which are substantially semi-cylindrical in shape.

Arranged in the lower half-shell 2 over its entire length is an underframe 4 or cradle for supporting fuel assemblies, the cross-section of which is T-shaped.

The cradle 4 comprises a base 4*a* and a partition wall 4*b* perpendicular to the base 4*a*.

The partition wall 4*b* delimits two bearing zones, each having the form of a right-angled dihedron, for two fuel assemblies 6 and 7, on the cradle 4.

The container 1 and the cradle 4 are slightly longer than the fuel assembly, the latter being over four metres long in the case of fuel assemblies for a pressurized-water nuclear reactor.

The fuel assemblies 6 and 7 are held on the cradle 4 by means of locking flanges 5, each consisting of two half-flanges 5*a* and 5*b*.

In the embodiment illustrated in FIG. 1, the half-flanges 5*a* are mounted in an articulated manner at one of their ends on the upper part of the partition wall 4*b* of the cradle 4, and the half-flanges 5*b* are articulated at one of their ends on the base 4*a* of the cradle 4.

The locking flanges 5 are arranged level with each of the spacer grids of the fuel assemblies 6 and 7 and form, with the cradle 4 and the clamping and locking means described hereinbelow, the component elements of the fastening device according to the invention.

The cradle 4 is held within the lower half-shell 2 by means of shock-absorbing devices (not shown).

The half-shell 3 forms a closing cover for the container, which can be fastened to the lower half-shell 2 by means of screw connections 10 in two parts.

The partition wall 4*b* of the cradle 4 delimits two bearing zones 9*a*, 9*b*, in the form of right-angled dihedra, for two fuel assemblies.

Figure 2:
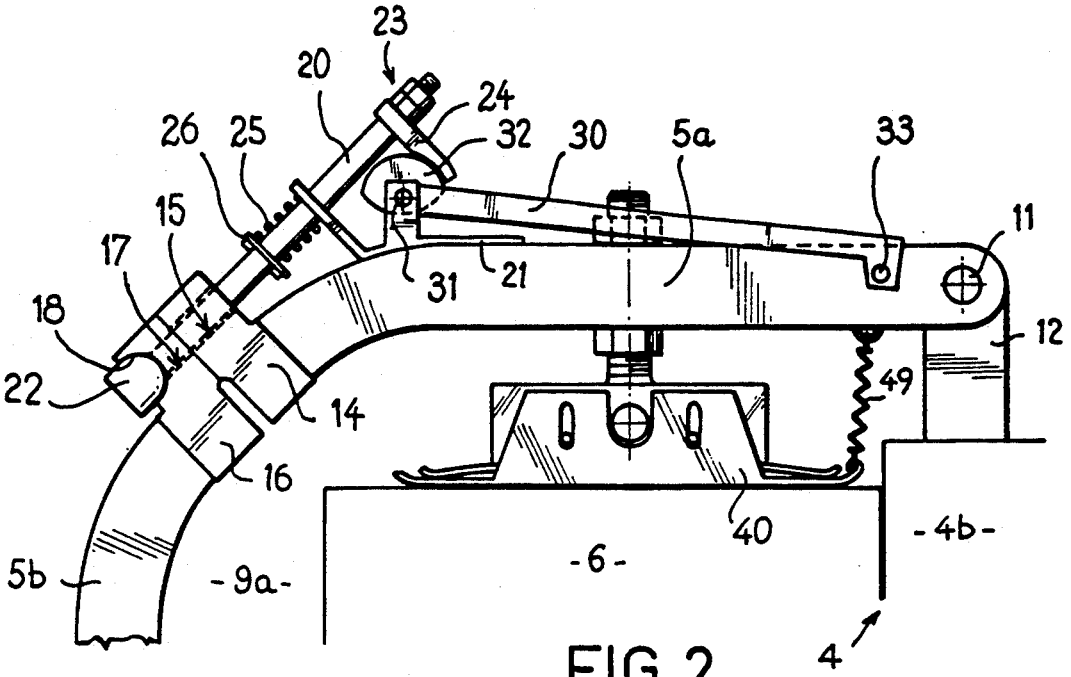
FIG. 2 is a side elevation view of a device according to the invention used for fastening a fuel assembly in a container, such as that shown in FIG. 1, in closed and locked position.

In the closed and locked position of the fastening device shown in FIG. 2, the flange 5*a* is turned down in the direction of the supporting surface of the base 4*a* of the cradle 4 and delimits, with the second half-flange 5*b* and with the supporting and bearing surfaces of the cradle 4, a contour of substantially square shape, the side of which is larger than the side of a fuel assembly of square cross-section, such as one of the assemblies 6 or 7.

The half-flange 5*a* is fastened in an articulated manner at one of its ends to the upper part of the partition wall 4*b* of the cradle 4 by means of a support 12 fastened to the partition wall 4*b* and of a pivot axle 11 arranged in the longitudinal direction of the container 1.

The half-flange 5*b* is fastened in an articulated manner to the base 4*a* of the cradle 4 and is placed in its turned-down position.

Figure 3:
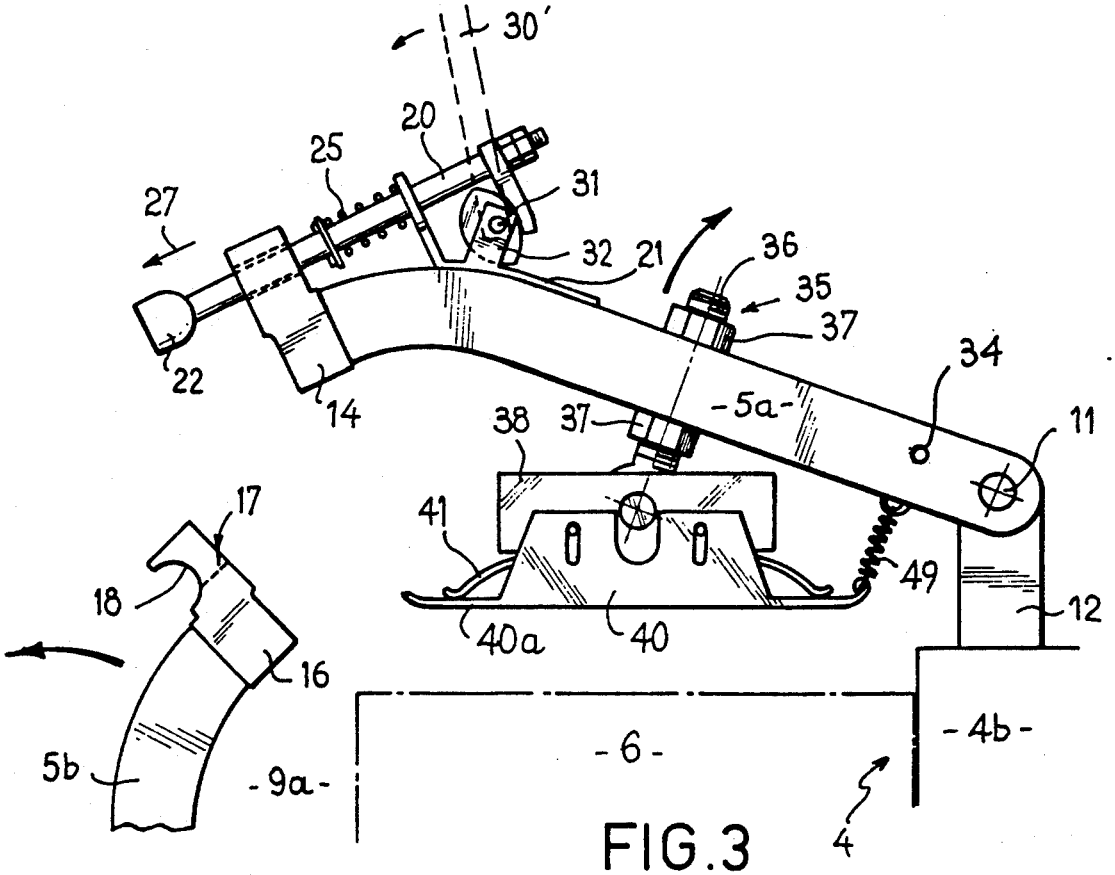
FIG. 3 is an elevation view of the fastening device shown in FIG. 2, in open position.

As can be seen in FIGS. 2 and 3, the half-flange 5*a* comprises, at its end opposite the joint 11, a junction piece 14, of which the outer part located above the flange 5*a* has a hollow cylindrical part 15.

Likewise, the half-flange 5*b* comprises, at its end opposite its end connected to the base 4*a* of the cradle 4, a junction piece 16, the outer part of which has an outwardly open hollow part 17.

In the turned-down position of the flange 5*a*, as illustrated in FIG. 2, the hollow parts 15 and 17 of the junction pieces 14 and 16 are juxtaposed and form a single receptacle for a locking rod 20 of the fastening device.

The junction piece 16 solid with the half-flange 5*b* further comprises a locking receptacle 18 in an arrangement opposite the junction piece 14.

The locking rod 20 is mounted slidably on the half-flange 5*a* by means of a supporting fitting 21 having an orifice, in which the rod 20 is engaged slidably.

The locking rod 20 is likewise engaged in the hollow part 15 of the junction piece 14 which, together with the orifice of the support 21, ensures the guidance of the rod 20 for axial translational movement.

The rod 20 comprises, at its end located in front of the junction piece 14, a dog 22 having a rounded bearing surface corresponding to the shape of the receptacle 18 of the junction piece 16.

The rod 20 comprises, at its end opposite the dog 22, a pusher 24 fastened by means of nuts 23 engaged on a threaded part of the rod 20.

The locking rod 20 is returned in the direction leading from the pusher 24 towards the dog 22 by a spring 25 interposed between the support 21 and an annular abutment 26 solid with the rod 20.

When the half-flange 5*a* is in its raised position, as shown in FIG. 3, the rod 20 is placed in an advanced position, under the effect of the push of the spring 25, as represented by the arrow 27.

In its advanced position, the locking rod 20 can be introduced from outside into the hollow part 17 of the junction piece 16 as a result of the tilting of the half-flanges 5*a* and 5*b*, the dog 22 being located outside the receptacle 18.

An actuating lever 30 is articulated, at one of its ends which is solid with a cam consisting of a cam 32, on the support 21 by means of an axle 31.

The lever 30 comprises, at its end opposite the joint 31, a locking finger 33 equipped with a return spring and capable of engaging into an orifice 34 of the half-flange 5*a*.

The lever 30 can be displaced by pivoting relative to the half-flange 5*a* between a turned-down position shown in FIG. 2, in which the lever 30 can be locked on the half-flange 5*a* by means of the finger 33, and a raised position 30' remote from the flange 5*a* and represented by broken lines in FIG. 3.

In the turned-down position of the lever 30, the outer actuating surface of the cam 32 cooperates with the pusher 24 to cause a retraction of the rod 20, counter to the action of the return spring 25, in the direction leading from the dog 22 towards the pusher 24.

This retraction movement of the rod 20 ensures the introduction of the dog 22 into the receptacle 18 of the junction piece 16 and the locking of the half-flange 5*a* on the half-flange 5*b*.

In the raised position 30' of the lever 30, shown in FIG. 3, the outer surface of the eccentric 32 directed towards the pusher 24 of the rod 20 allows an advancing movement of the locking rod 20 in the direction of the arrow 27, the cam 32 comprising an outer surface, remote from the axle 31 and located opposite the pusher 24 in the turned-down position of the lever 30, and an outer surface, near the axle 11 and located opposite the pusher 24 in the raised position 30' of the lever 30, these surfaces being such that the displacement of the locking rod 20 begins only after the lever 30 has passed the vertical position.

The fastening device according to the invention further comprises means for clamping the assembly 6 to the supporting surface of the cradle 4; this will be described with reference to FIGS. 2 to 7.

These clamping means 35 are fastened to the half-flanges 5*a* and 5*b* by means of eyebolts 36, fastening nuts 37 and lock nuts 37'.

The means 35 comprise a bearing block 38, a shoe 40 and a leaf spring 41 interposed between the bearing block 38 and the shoe 40.

Figure 5:
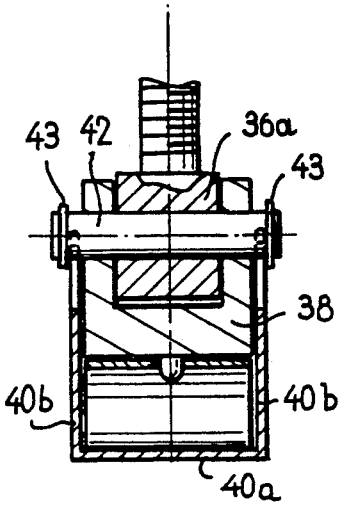
FIG. 5 is a sectional view along line 5—5 in FIG. 4.

The bearing block 38 has a central orifice, in which is engaged the end 36*a* of the eyebolt 36, delimited by two lateral walls through which pass aligned orifices opening into the central cavity (FIG. 5). The part 36*a* of the eyebolt comprises a through-orifice arranged in alignment with the orifices of the lateral walls of the bearing block 38.

The circular orifices of the lateral walls of the block 38 and the corresponding orifice of the part 36*a* of the eyebolt have an axle parallel to the articulation and pivot axle 11 of the half-flange 5*a*.

A pivot axle 42 is engaged in the aligned orifices of the block 38 and of the eyebolt and is retained by stop rings 43, in such a way that the bearing block 38 is fastened pivotably relative to the half-flange 5*a* at the end of the eyebolt 36.

The shoe 40 comprises a plane bearing plate 40*a* and two parallel lateral faces 40*b*, the spacing of which is slightly greater than the width of the bearing block 38.

Each of the lateral faces of the shoe 40 comprises a central indentation 44 opening out in the upper part of the face 40*b*, and two closed oblong orifices 45 arranged symmetrically relative to the indentation 44 in the upper part of the face 40*b*.

Two detent pins 46 are fastened to the lateral faces of the bearing block 38 at a spacing corresponding to the spacing of the oblong orifices 45 of the shoe 40.

Each of the detent pins 46 is engaged in an orifice 45, so as to make the connection between the bearing block 38 and the shoe 40, while at the same time allowing some freedom of movement of the shoe 40 relative to the bearing block 38 in the axial direction of the eyebolt 36.

The spring 41 is a leaf spring having a convex part directed towards the shoe 38 which comprises a concave outer bearing surface 38*a* coming into contact with the outer convex surface of the leaf spring 41, which has ends bearing on the inner face of the bearing plate 40*a* of the shoe 40.

The spring 41, which is interposed between the bearing block 38 and the shoe 40, further comprises an orifice which passes through its wall at the vertex of its convex part and in which is engaged a centering stud 48 fastened to the contact surface 38*a* of the bearing block 38.

Figure 4:
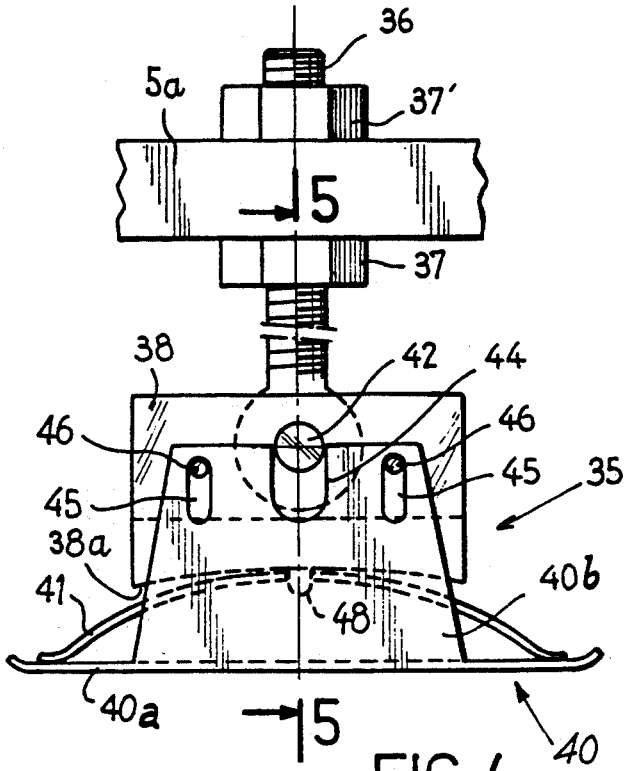
FIG. 4 is an elevation view of a bearing shoe of the fastening device shown in FIGS. 2 and 3, in unclamped position.

When the half-flanges 5*a* and 5*b* are in their open position, as shown in FIG. 3, the shoes 40 are in their position of rest, shown in FIG. 4. The springs 41 maintain the spacing between the bearing blocks 38 and the shoes 40 at its maximum value, the pins 46 being in abutment against the upper part of the oblong orifices 45.

Moreover, return and holding springs 49 are fastened at one of their ends to the shoes 40 and at their other ends to the half-flanges 5*a* and 5*b*, so as to keep the shoe 40 in such a position relative to the half-flanges 5*a* and 5*b* that the bearing plate 40*a* is substantially perpendicular to the upper surface and parallel to the lateral surface of the assembly 6, consisting of the outer face of a spacer, during the pivoting of the half-flanges 5*a* and 5*b* between their opening and closing positions, shown in FIGS. 3 and 2, respectively.

The spring 49 also makes it possible to put the shoe 40 into a set-apart position during the opening of the half-flanges 5*a* and 5*b*, in order to facilitate unloading of assembly 6 from easily cradle 4 easily.

An assembly 6 resting on the supporting surface of the cradle 4 is locked by turning down the half-flanges 5*a* and 5*b* in the direction of the assembly 6, of the supporting surface of cradle 4 and of the partition wall, the lever 30 being in its raised position 30'.

The bearing plates 40*a* of the shoes 40 come into contact with the upper and lateral surfaces of the assembly 6, and a push on the half-flanges 5*a* and 5*b* ensures that the junction pieces 14 and 16 of the respective flanges 5*a* and 5*b* are brought into alignment and that the locking rod 20 is introduced into the hollow part 17 of the junction piece 16.

The lever 30 is then turned down manually into its position shown in FIG. 2 and is locked in this position by means of the locking finger 33.

The turning-down of the lever 30 causes the rotation of the cam 32 which actuates the pusher 24 and the locking rod 20 in the direction opposite of retraction of the rod in the direction opposite to the arrow 27. The dog 22 of the locking rod cooperates with the receptacle 18 in order to lock the half-flange 5*a* on the half-flange 5*b*.

The displacements of the half-flanges 5*a* and 5*b* by pivoting, during their locking, in the direction of the assembly 6 and of the supporting surface of the cradle 4 and of the partition wall, bring about a displacement of the bearing blocks 38 in the axial direction of the bolts 36 in relation to the shoes 40, the bearing plates 40*a* of which are in contact with the assembly 6. The springs 41 are compressed between the bearing blocks 38 and the inner surface of the bearing plate 40*a* of the shoes 40.

Figure 6:
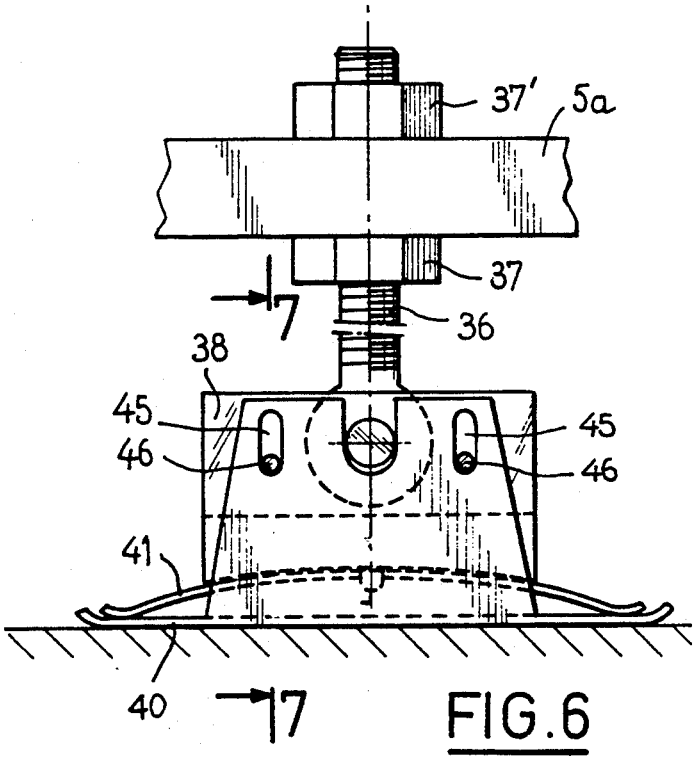
FIG. 6 is an elevation view of a bearing shoe of the fastening device shown in FIGS. 2 and 3, in position for clamping a fuel assembly.
Figure 7:
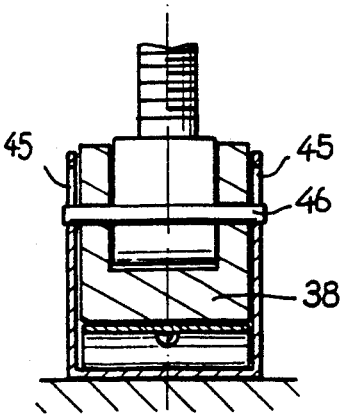
FIG. 7 is a sectional view along line 7—7 in FIG. 6.

The bearing block 38 and the shoe 40 are then in their relative position shown in FIGS. 6 and 7, the pins 46 being located in the lower part of the orifices 45.

The bearing force of the half-flanges 5*a* and 5*b* is transmitted by the eyebolts 36, the nuts 37 and the axle 42 to the bearing blocks 38, which transmit the clamping force to the shoes 40 by means of the springs 41. This ensures simultaneous locking of the half-flanges 5*a* and 5*b* and clamping of the assembly with a precisely predetermined force.

In fact, the spring has a shape and characteristics such that its deformation during the closing and locking of the flange makes it possible to obtain a predetermined clamping force.

This clamping force is calculated so that the fastening device and the spring withstand accelerations of the order of 6 g in the closed position of the half-flanges 5*a* and 5*b*. Moreover, the deformation of the spring makes it possible to absorb the dimensional differences of the spacer grids of the assembly.

The nuts 37 and lock nuts 37' ensuring the fastening of the bolts 36 to the half-flanges 5*a* and 5*b* make it possible to adapt the fastening device to various fuel assembly designs and to adjust the clamping force so that the fastening device withstands accelerations of the order of 6 g.

In its deformed position, as shown in FIG. 6, the outer convex surface of the spring 41 mates with the concave surface 38*a* of the bearing block 38.

The detent pins 46 make it possible to detain and block the shoe 40 in relation to the bearing block, these detent pins cooperating with the edges of the orifices 45 and, if appropriate, being capable of coming into abutment against the end part of the orifices 45, in the event that the fuel assembly is subjected to accelerations higher than 6 g which cause its displacement in relation to the supporting surface of the cradle.

This prevents a complete separation of the fuel assembly and cradle when the container undergoes high accelerations or shocks.

Of course, the detent pins 46 also make the connection between the shoe 40 and the block 38 in all the positions of fastening device.

Should the lever 30 accidentally happen to be released inside the container, the end of the lever comes into abutment against the cover of the container and its configuration is such that, in this partially open position, the eccentric continues to keep the locking rod and the dog 22 in their locking position. The flange 5*a* can be unlocked only when the lever 30 passes beyond its vertical position.

The flanging and locking of a fuel assembly in a transport container are carried out by using a fastening device according to the invention which comprises a plurality of pivoting flanges equipped with clamping means of the above-described type and arranged level with a plurality of spacer grids spaced over the length of the assembly.

In the case of fuel assemblies for a nuclear reactor of a power of 900 MW, three flanges equipped with locking means are arranged level with the first, fifth and eighth spacers, starting from the foot of the assembly.

In the case of fuel assemblies for nuclear reactors of a power of 1300 MW, flanges equipped with locking means are arranged level with the first, sixth and tenth spacer grid, starting from the foot of the assembly.

Other fuel assembly holding flanges which are of the same type, but which are not equipped with locking means, can be arranged level with the other spacer grids of the assemblies.

The flanges are unlocked and opened, after opening the container, by release of the actuating lever which is subsequently raised into its position 30' shown in FIG. 3. The upward pivoting of the lever 30 brings about an advance of the locking rod 20 under the effect of the return spring 25. The half-flange 5*a* can then be pivoted upwards and the half-flange 5*b* downwards, so as to free the assembly 6.

The return spring 49 of the shoe 40 makes it possible to place the shoe in a set-aside position assisting the passage and removal of the fuel assembly.

The flanging and locking of the fuel assembly and its unlocking can therefore be carried out by means of simple and rapid operations which do not involve screw connections and which do not require the use of special clamping or unclamping tools, such as torque wrenches.

It is thus possible to reduce considerably the attendance time of operators for carrying out the flanging and locking as well as the unlocking of the fuel assemblies within a transport container. Insofar as these operations are to be conducted on a very large number of containers, in fuel assembly production units or on the site of nuclear reactors, a considerable amount of time is saved as a result.

Moreover, the force clamping the fuel assemblies in their transport container can easily be set at a precisely predetermined value, so that there is no need for any check when the fuel assemblies are flanged and locked.

These operations can be executed without the need to employ competent, trained personnel.

The shoe, the bearing block and the spring of the clamping device, which are fastened to the pivoting flange, can have a form different from that described and comprise fastening, assembling and adjusting means of any type.

The flanges can consist of two half-flanges mounted pivotably on the cradle of the container and each comprising a shoe and a clamping device, as described above, or can be in one piece mounted pivotably on the cradle and fastened to a fixed junction piece solid with part of the cradle.

The locking means of the flange can be different from the means which have been described and which comprise a locking rod actuated by an actuating lever and having a locking dog.

Finally, the fastening device according to the invention can be used for carrying out the flanging and locking of objects other than a fuel assembly on a transport structure.

I claim:

1. In a transport structure comprising a cradle having at least one supporting surface, on which an object rests, and at least one flange mounted for pivoting movement about an axle on said cradle between a raised position, remote from said supporting surface and said object, and a position turned down in a direction of said supporting surface and said object, as well as means for locking said flange in its turned-down position, a device for fastening said object comprising (a) at least one clamping set consisting of a bearing block connected to said flange in an articulated manner about an axle substantially parallel to said axle of said flange;

(b) a shoe mounted on said bearing block for limited displacement in relation to said bearing clock in a direction enabling selective movement of said shoe toward and away from said bearing block and said flange and comprising a bearing surface directed towards said supporting surface of said cradle, in said turned-down position of said flange; and (c) a leaf spring interposed between said bearing block and said shoe and exerting a return force on said shoe in a direction away from said bearing block and said flange.

2. Device according to claim 1, wherein said bearing block is connected to said flange by means of an eyebolt fastened to said flange by means of a ut and of a lock nut and having an end part having an orifice and engaged in a cavity of said bearing block level with orifices passing through said bearing block, a pivot axle being engaged in said orifices of said end part of said eyebolt and of said bearing block upon alignment of said orifices.

3. Device according to claim 1 or 2, comprising a spring for returning said shoe into set-apart position, said spring being interposed between said shoe and said flange.

4. Device according to claim 1 or 2, wherein said shoe comprises two parallel lateral faces between which said bearing block is engaged, and each of said faces comprising two oblong through-orifices in each of which is engaged a detent pin solid with said bearing block.

5. Device according to claim 1 or 2, wherein said leaf spring comprises a through-orifice in which is engaged a centering stud solid with a face of said bearing block in contact with said spring.

6. Device according to claim 1 or 2, wherein said flange consists of a first half-flange and a second half-flange, both of said half-flanges being articulated at one of their ends on said cradle and being movable between an open position, in which said half-flanges are apart from one another, and a closing position, in which said half-flanges come into contact at their ends opposite their articulated ends and can be connected by the locking means of said flange, each of said half-flanges comprising a clamping set consisting of a bearing block, a shoe and a spring.

7. Device according to claim 6, wherein locking means of said flange comprise a first junction piece solid with said first half-flange (5*a*), a second junction piece solid with said second half-flange and having a locking receptacle, said first and second junction pieces being arranged in such a way that two hollow parts of said junction pieces, which are juxtaposed in the closing position of said flange, form a single receptacle, a locking rod mounted slidably on said first half-flange and comprising a first end bearing a locking dog and a second end bearing a pusher, a spring for returning said locking rod in a direction leading from said pusher towards said dog, and an actuating lever pivotably mounted on said first half-flange between a raised position and a turned-down position, solid with a cam for actuating said pusher of the locking rod and comprising a means for locking in the turned-down position on said first half-flange, said cam having a shape adapted to allow a return of said locking rod under the effect of said spring into a position allowing said locking rod to engage into said receptacle of said junction pieces, in the raised position of said lever, and to cause a retraction of said rod counter to said spring in the turned-down position of said lever, ensuring introduction and locking of said dog in said locking receptacle of said second junction piece.

8. Device according to claim 7, wherein said cradle comprises a base and a partition wall which are perpendicular to one another, and wherein said first half-flange is articulated on said partition wall and said second half-flange is articulated on said base of said cradle.

9. Device according to claim 7, wherein said cam is in the form of an eccentric.

10. Device according to claim 1 or 2, for fastening a fuel assembly for a nuclear reactor in a transport container, said device comprising spacer grids spaced over a longitudinal direction of said fuel assembly, said device comprising a plurality of flanges mounted pivotably on said cradle, each of said flanges being level with a spacer grid of said fuel assembly resting on said supporting surface of said cradle, in such a way that said shoe connected to said flange comes to bear on an outer face of said spacer grid of said fuel assembly.

* * * * *